US007885585B2

(12) United States Patent
Uchino et al.

(10) Patent No.: US 7,885,585 B2
(45) **Date of Patent: *Feb. 8, 2011**

(54) DEVELOPING ROLLER AND IMAGE FORMING METHOD EMPLOYING THE SAME

(75) Inventors: Satoshi Uchino, Tokyo (JP); Nobuaki Kobayashi, Tokyo (JP); Takeo Oshiba, Tokyo (JP); Okushi Okuyama, Tokyo (JP); Kouichi Sugama, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 880 days.

This patent is subject to a terminal disclaimer.

(21) Appl. No.: 11/681,229

(22) Filed: Mar. 2, 2007

(65) Prior Publication Data

US 2007/0269240 A1 Nov. 22, 2007

(30) Foreign Application Priority Data

May 18, 2006 (JP) ..... 2006-138691

(51) Int. Cl.
*G03G 15/08* (2006.01)

(52) U.S. Cl. ..... 399/286

(58) Field of Classification Search ..... 399/286
See application file for complete search history.

(56) References Cited

U.S. PATENT DOCUMENTS

| | | | | |
|---|---|---|---|---|
| 5,705,274 | A * | 1/1998 | Inoue et al. | 428/411.1 |
| 6,270,449 | B1 * | 8/2001 | Hirayama | 492/54 |
| 6,390,961 | B1 * | 5/2002 | Nakada et al. | 492/56 |
| 2004/0248025 | A1 * | 12/2004 | Miyakawa | 430/107.1 |
| 2007/0269239 | A1 * | 11/2007 | Uchino et al. | 399/286 |
| 2008/0292366 | A1 * | 11/2008 | Akama et al. | 399/286 |

* cited by examiner

*Primary Examiner*—Ryan D Walsh
(74) *Attorney, Agent, or Firm*—Lucas & Mercanti, LLP

(57) ABSTRACT

An objective is to provide a developing roller in which increase of residual potential is inhibited during repetitive operation without deteriorating adhesion to an elastic layer, scattering and leakage of toner are prevented, appropriate elasticity is exhibited and a resin layer capable of preventing uneven charging of toner and image unevenness is prepared, and also to provide a image forming method employing the developing roller. Disclosed is a developing roller possessing an elastic layer made of silicone rubber provided around a conductive shaft, and a resin layer further provided on the elastic layer, wherein the resin layer contains polyurethane resin-silica hybrid as a principal component.

6 Claims, 3 Drawing Sheets

FIG. 3 ( a )
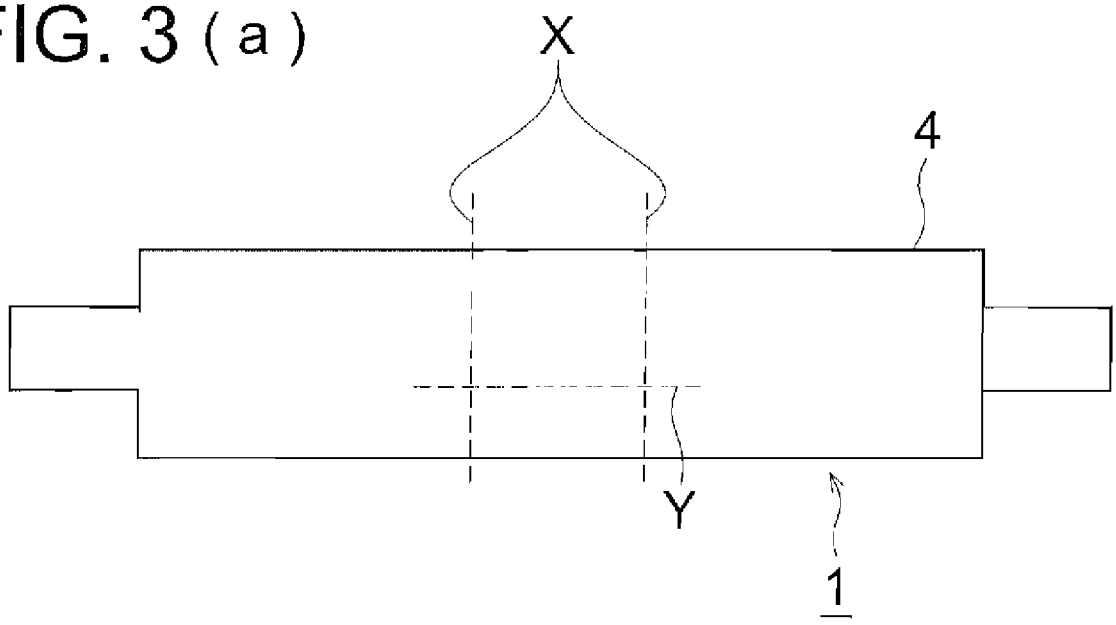
FIG. 3 ( b )
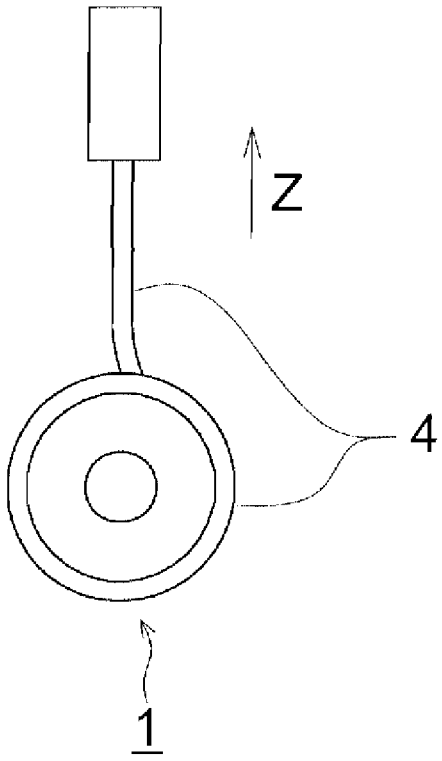

DEVELOPING ROLLER AND IMAGE FORMING METHOD EMPLOYING THE SAME

This application claims priority from Japanese Patent Application No. 2000-138691 filed on May 18, 2006, which is incorporated hereinto by reference.

TECHNICAL FIELD

The present invention relates to a developing roller installed in an image forming apparatus employing an electrophotographic process used for a printer, a facsimile receiver and so forth, and specifically to a developing roller used for a development device employing a non-magnetic single component development process and an image forming method utilizing the developing roller.

BACKGROUND

Currently, a widely available electrophotographic image forming method is a method in which a final image is formed via a fixing process after transferring into a plain paper sheet a toner image on an electrostatic latent image carrier, which is formed via a developing process to visualize an electrostatic latent image with toner, by bringing a charge-provided toner into contact with the electrostatic latent image formed on the electrostatic latent image carrier (usually referred to as an electrophotographic photoreceptor), or by making the toner to face the electrostatic latent image carrier via a narrow spacing.

As development processes to form toner images, there are a double component development process in which toner is charged and developed employing a double component developer composed of a carrier and the toner, and also a single component development process in which a developer consisting of toner is conveyed by a developing roller, and charged via friction with a developer regulating member or such to conduct a development treatment. This single component development process has widely been used in recent years since no carrier needs to be used in this process, and a developing device can also be simplified. With the recent development of colorization, attention has been focused on a non-magnetic single component process employing toner with no content of a magnetic material since the colorization is possible with it.

This process differing from the double component development process has the advantage that the development device mechanism is not complicated, and is easily downsized, since friction of only toner is caused with an electrification member without using a carrier, or electrification is caused by pressing the carrier on the developing roller surface. As the result, it is further a feature that this process is also usable for a color image forming apparatus usually employing at least 4 development mechanisms.

Usually, a developing roller comprising an elastic layer composed of silicone rubber provided around the outer circumferential surface of a conductive shaft, for example, has been utilized for a developing roller with this non-magnetic single component development process. A developing device having a very simple mechanism is to be employed since a toner thin layer is formed on the developing roller using an electrification member such as a metal plate or a roller, and friction is caused with this, in order to charge the toner.

This developing roller comprises an elastic layer composed of a rubber elastic body such as silicone rubber provided around the outer circumferential surface of a shaft (or a spindle) made of a metal or a conductive resin, but it is commonly known that a surface layer is formed on the elastic layer employing other resins, in order to acquire toner conveyance and electrification. It is also known, for example, that a fluorine-containing rubber is employed on an elastic layer in order to provide electrification to toner together with toner conveyance, and to further prevent toner adhesion and fusing. In order to form a fluorine-containing rubber layer on the elastic layer, it is also known that an intermediate layer composed of a silane coupling agent is formed on the elastic layer surface, and an outermost layer composed of a fluorine-containing rubber as a principal component is further formed on the intermediate layer (refer to Patent Document 1).

However, it is desired that a toner layer formed on the developing roller via toner regulating conveyance during image formation is rubbed by an electrification member, or it is strongly pressed against the elastic layer surface to cause electrification. It is common that a plurality of structural layers are provided on the elastic rubber layer in order to protect the outer layer surface from scratches, or to sufficiently produce toner electrification with a desired polarity.

In this case, a strong frictional force to charge a toner layer formed on developing roller is applied, or a pressing force is applied with an electrification member during electrification, whereby a large force is also applied to the developing roller. As the result, the elastic layer on the roller shaft is locally deformed or distorted. A deforming stress applied between this elastic layer and a coated layer provided on it becomes large as a matter of course, whereby peeling or cracking tends to be generated. Accordingly, a technique utilizing a non-magnetic single component development process has been demanded to solve the above-described problems.

The non-magnetic single component development is also capable of receiving and transferring electric charge between the toner and the developing roller, and counter electric charge of the toner is accumulated on the developing roller surface. This counter electric charge is removed by leaking it into the developing roller to constantly neutralize charge on the developing roller surface. However, when the foregoing structure is employed, no charge formed on a surface layer is effectively leaked since an intermediate layer serves as a barrier layer in this case, whereby residual charge on the developing roller surface is increased, resulting in occurrence of a problem such as scattering of toner and so forth.

(Patent Document 1) Japanese Patent O.P.I. Publication 8-190263

SUMMARY

In a conventional roller, increase of residual potential is generated during repetitive operation since a layer immediately above an elastic layer is an insulating silane coupling agent layer. As a result, there has been a problem such that scattered toner and toner leakage are generated.

The present invention was made on the basis of the above-described situation. It is an object of the present invention to provide a developing roller in which increase of residual potential is inhibited during repetitive operation without deteriorating adhesion to an elastic layer, scattering and leakage of toner are prevented, appropriate elasticity is exhibited and a resin layer capable of preventing uneven charging of toner and image unevenness is prepared, and also to provide a image forming method employing the developing roller. Disclosed is a developing roller possessing an elastic layer made of silicone rubber provided around a conductive shaft, and a resin layer further provided on the elastic layer, wherein the resin layer contains a polyurethane resin-silica hybrid as a principal component.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which:

FIG. 3(*a*) is a side view of the developing roller;

FIG. 3(*b*) is a schematic diagram to explain a measuring method of interlayer adhesion between an elastic layer and a resin layer of the developing roller;

DESCRIPTION OF THE PREFERRED EMBODIMENTS

Figure 1:
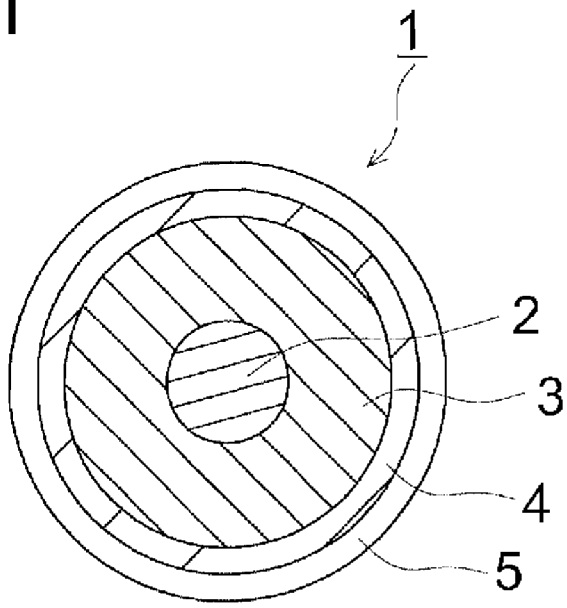
FIG. 1 is a schematic cross-sectional view showing an example of the developing roller of the present invention.

In order to solve the above-described problems, disclosed is a developing roller comprising an elastic layer made of silicone rubber provided around a conductive shaft, and a resin layer further provided on the elastic layer, wherein a layer immediately above the elastic layer is the resin layer composed of a polyurethane resin-silica hybrid as a principal component.

After considerable effort during intensive studies, the inventors have found out that the above-described problems can be solved by providing toner conveyance and electrification, and simultaneously improving adhesion to the elastic layer via formation of the resin layer composed of a polyurethane resin-silica hybrid as a principal component which is a layer immediately above the elastic layer.

Since the resin layer composed of a polyurethane resin-silica hybrid of the present invention as a principal component contains a urethane resin to improve adhesiveness, and has a hybrid with a inorganic structure such as silica internally, no layer made of a silane coupling agent needs to be provided, whereby it is assumed that sufficient charge leakage can be acquired through the layer, and increase of residual potential can also be prevented. Further, a resin becomes capable of exhibiting elasticity by having an urethane resin moiety, and adhesiveness to the elastic layer as a lower layer can also be improved.

(Structure 1) A developing roller comprising an elastic layer made of silicone rubber provided around a conductive shaft, and a resin layer further provided on the elastic layer, wherein the resin layer comprises a polyurethane resin-silica hybrid as a principal component.

(Structure 2) The developing roller of Structure 1, wherein a silane moiety content in the polyurethane resin-silica hybrid is 1.0-30.0% by weight.

(Structure 3) The developing roller of Structure 1 or 2, wherein the polyurethane resin-silica hybrid comprises a urea bond.

(Structure 4) An image forming method comprising the steps of conveying a developer comprising a toner to a developing region with a developing roller, and developing an electrostatic latent image formed on an electrostatic latent image carrier for visualization, wherein the developing roller comprises an elastic layer made of silicone rubber provided around a conductive shaft, and a resin layer further provided on the elastic layer, and the resin layer comprises a polyurethane resin-silica hybrid as a principal component.

(Structure 5) The image forming method of Structure 4, wherein a silane moiety content in the polyurethane resin-silica hybrid is 1.0-30.0% by weight.

(Structure 6) The image forming method of Structure 4 or 5, wherein the polyurethane resin-silica hybrid comprises a urea bond.

In addition, a layer to further provide a function to the upper layer above a polyurethane resin-silica hybrid may be prepared in the present invention. In this case, a silicone resin or a fluorine resin are usable for providing electrification, as described before. Since a resinous polyurethane resin-silica hybrid of the present invention possesses a polar component and a nonpolar component in the case of this structure, adhesiveness to the silicone resin or the fluorine resin having comparatively low surface energy can also be improved.

It is found out that problems can be solved by not merely forming an adhesive layer of insulation for silicone rubber employed for an elastic layer of the present invention, but forming a resin layer having a so-called hybrid resin structure.

Since the after-mentioned structure of a polyurethane resin-silica hybrid usable in the present invention possesses a polyurethane unit in the moiety, it has high affinity with the resin even in the case of forming a surface layer from a silicone copolymerization polyurethane resin to improve adhesiveness. The silica hybrid structure becomes capable of improving adhesion to silicone rubber constituting the elastic layer, and simultaneously serving as a charge leakage point since there exists an inorganic structure of a silica unit. Accordingly, it is assumed that the accumulation of electric charge on the developing roller surface is prevented, whereby problems of the present invention can be solved.

Incidentally, the content "as a principal component" in the present invention means a content of at least 50% by weight, and the silane moiety also means a moiety having a silane or siloxane structure.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, the embodiments of the present invention will be explained in detail.

[Developing Roller]

A conductive shaft is employed as a spindle for a developing roller, and a conductive elastic layer made of silicone rubber and a resin layer composed of a polyurethane resin-silica hybrid as a principal component are formed around the shaft. A surface layer composed of a silicone copolymerization polyurethane resin as a principal component may also be formed, if desired.

FIG. 1 shows a schematic cross-sectional view of developing roller 1 of the present invention. Developing roller 1 is composed of conductive shaft (spindle) 2, elastic layer 3, resin layer 4 and surface layer 5, if desired.

(Conductive Shaft)

The conductive shaft constituting a spindle is preferably made of conductive metal since the shaft serves as a member by which electric charge accumulated on the developing roller surface is leaked. Typical examples thereof include conductive metals such as stainless steel (SUS304, for example) having a diameter of 1.0-30 mm, iron, aluminum, nickel, an aluminum alloy and a nickel alloy. Further, the shaft may also be composed of conductive resin.

(Elastic Layer)

Silicone rubber employed for an elastic layer of the present invention which may be silicone rubber conventionally used in this industry is prepared by adding an inorganic filler, benzoyl peroxide and so forth into organopolysiloxane, and subsequently vulcanizing and curing the resulting after conducting kneading and molding processes. It, for example, can be obtained by crosslinking methylvinylpolysiloxane made of dimethylpolysiloxane and methylvinylsiloxane with organic peroxide. Though the elastic modulus depends on the degree of crosslinking, an elastic body having a JIS A hardness of approximately 10-60° is preferably employed in the present invention.

This elastic layer having low resistivity obtained by adjusting resistivity is also employed. In order to make resistivity lower, low resistive components such as carbon black, graphite, zinc oxide, tin oxide and titanium oxide are preferably contained. In this case, the usable material preferably has a volume resistivity of $1\times10^{-4}$-$1\times10^{4}$ Ω·cm. Particularly preferable are graphite, Ketjen black and acetylene black. Further, the addition amount is not specifically limited, but the addition amount is preferably 10-100 parts, based on 100 parts of silicone rubber.

(Resin Layer)

A resin layer of the present invention comprises a layer composed of a polyurethane resin-silica hybrid as a principal component. This has a polyurethane moiety, and is united with a silica structure. Further, this is not particularly limited, but it, for example, can be prepared by a method described in Japanese Patent O.P.I. Publication No. 2002-220431. That is, it is produced with polyhydric alcohol and a polyisocyanate compound, and the polyurethane resin-silica hybrid can be prepared by curing an alkoxy group-containing silane modified polyurethane resin obtained via reaction of (1) a polyurethane resin having a functional group reactive to an epoxy group and (2) an epoxy group-containing alkoxysilane partial condensate acquired via dealcoholization reaction of (A) an epoxy compound having at least a hydroxyl group in a molecule and (B) an alkoxysilane partial condensate. In addition, a urea bond may also be formed by reacting an isocyanate group and an amine group via addition of amine during reaction. It is preferable that intermolecular adhesion is improved by coexisting a urea bond and an urethane bond, whereby durability is also improved.

The polyhydric alcohol is not particularly limited, but preferably provided are polyester polyol, polycarbonate polyol, polyether polyol and polyolefin polyol which have a hydroxyl group at the terminal. The polyhydric alcohol having a certain level of high molecular weight is preferable in view of improving elasiticity, together with mechanical properties of a hardened material, and is preferably a number average molecular weight of 1000-6000. In addition, the number average molecular weight can be determined as a styrene conversion number average molecular weight employing a GPC (gel permeation chromatography).

Of the above-described polymer polyols, polyester polyol and polycarbonate polyol are specifically preferable in view of various properties such as high temperature durability of the resulting polyurethane resin-silica hybrid and so forth.

Examples of the polyester polyol include commonly known, various saturated or unsaturated low molecular glycols such as ethylene glycol, diethylene glycol, triethylene glycol, 1,2-propanediol, 1,3-propanediol, 1,3-butanediol, 1,4-butanediol, neopentyl glycol, pentanediol, 3-methyl-1,5-pentanediol, 1,6-hexanediol, octanediol, 1,4-butynediol, dipropylene glycol; alkylglycidyl ethers such as n-butylglycidyl ether and 2-ethylhexylglycidyl ether; monocarboxylic acid glycidyl esters such as versatic acid glycidyl ester and so forth; dibase acid or acid anhydride thereof, and dimer acid such as adipic acid, maleic acid, fumaric acid, acid phthalic anhydride, isophthalic acid, terephthalic acid, succinic acid, axalic acid, malonic acid, glutaric acid, pimelic acid, azelaic acid, sebacic acid and suberic acid; and polyester polyols obtained via dehydration-condensation of caster oil and its fatty acid or via ring-opening polymerization of a cyclic ester compound.

Polycarbonate polyols can be prepared via commonly known reaction such as demethanol condensation reaction of polyhydric alcohol and dimethylcarbonate, deurethane condensation reaction of polyhydric alcohol and diphenyl carbonate, or deethyleneglycol condensation reaction of polyhydric alcohol and ethylene carbonate. Examples of the polyhydric alcohol employed in this reaction include commonly known various saturated or unsaturated low molecular glycols such as 1,6-hexanediol, diethylene glycol, Propylene glycol, 1,3-butanediol, 1,4-butanediol, neopentylglycol, pentane diol, 3-methyl-1,5-pentanediol, octanediol, 1,4-butynediol and dipropylene glycol; and alicyclic glycols such as 1,4-cyclohexane diglycol and 1,4-cyclohexane dimethanol.

Examples of polyester polyols include polyethylene glycol, polypropylene glycol and polyoxytetramethylene glycol prepared via ring-opening polymerization of ethylene oxide, propylene oxide or tetrahydrofran.

Commonly known various aromatic, fatty or alicyclic polyisocyanates are usable as a polyisocyanate compound being a composition component in polyurethane resin (1), and a diisocyanate compound is preferable in view of providing elasticity.

Examples thereof include 1,5-naphtylene diisocyanate, 4,4'-diphenylmethane diisocyanate, 4,4'-diphenyldimethylmethane diisocyanate, 4,4'-dibenzylisocyanate, dialkyldiphenylmethane diisocyanate, tetraalkyldiphenylmethane diisocyanate, 1,3-phenylene diisocyanate, 1,4-phenylene diisocyanate, tolylene diisocyanate, butane-1,4-diisocyanate, hexamethylene diisocyanate, isopropylene diisocyanate, methylene diisocyanate, 2,2,4-trimethylhexamethylene diisocyanate, 2,4,4-trimethylhexamethylene diisocyanate, cyclohexane 1,4-diisocyanate, xylylene diisocyanate, hydrogenated xylylene diisocyanate, isophorone diisocyanate, lysine diisocyanate, dicyclohexylmethane-4,4'-diisocyanate, 1,3-bis(isocyanatemethyl)cyclohexane, methylcyclohexane diisocyanate, m-tetramethylxylylene diisocyanate, and dimer diisocyanate in which a carboxyl group in a dimer acid is transformed into isocyanate group.

A chain extension agent for extending a molecular chain is also usable for polyurethane resin (1). Examples of the chain extension agent include low molecular glycols described in the foregoing paragraph of polyester polyol, for example; glycols having a carboxyl group in a molecule such as dimethylolpropionic acid or dimethylolbutanoic acid; polyamines such as dimerdiamine and so forth in which a carboxyl group in ethylenediamine, propylenediamine, hexamethylenediamine, triethylenetetramine, diethylenetriamine, isophoronediamine, dicyclohexylmethane-4,4'-diamine or a dimer acid is transformed into an amino group; and polyamines having a carboxyl group in a molecule such as L-lysine or L-arginine. A urea bond can be formed by providing amines as the chain extension agent. That is, the amount of this urea bond is preferably 1-10 mol %, based on the urethane bond. The amount can be adjusted by adding 1-10 mol % after glycols are to be set to 90-99 mol % during reaction. The interaction through an intermolecular hydrogen bond is generated via coexistence of the urea bond and the urethane bond in a molecule, whereby durability and adhesion of the resulting resin layer can be improved. In the case of the amount of the urea bond being too small, no adhesion can be improved since this intermolecular interaction is deteriorated. On the other hand. In the case of the amount of the urea bond being excessive, adhesion is further lowered since repulsion in the excessive amount of urea bond is produced though the intermolecular interaction is more or less observed.

A polymerization terminator for adjusting a molecular weight is also usable for the polyurethane resin of the present invention. Examples of the polymerization terminator include alkylmonoamines such as di-n-butylamine or n-butylamine; monoamines having a carboxyl group in a molecule such as D-alanine or a D-glutamic acid; alcohols such as ethanol, isopropyl alcohol and so forth; and alcohols having a carboxyl group in a molecule such as a glycolic acid and so forth.

A functional group having an epoxy group in polyurethane resin (1) together with reactivity may be at the terminal or in the principal chain of polyurethane resin (1). Examples of the functional group include a carboxyl group, a sulfonate group, a phosphate group, an acidic group, an amino group, a hydroxyl group, a mercapto group and so forth. Of these, an acidic group and an amino group are preferable in view of reactivity with an epoxy group and functional group providing easiness. A method of providing an acidic group in polyurethane resin (1) is not limited, but a functional group can be provided by using a compound containing the foregoing functional group as the aforementioned chain extension agent or polymerization terminator.

As the method of producing polyurethane resin (1) employed in the present invention, provided are a one step method in which polymeric polyol, a diisocyanate compound, and at least one of the chain extension agent and polymerization terminator if desired are simultaneously reacted in an appropriate solvent; and a two step method in which polymeric polyol and a diisocyanate compound are reacted under the condition of an excessive amount of isocyanate group to prepare a prepolymer having an isocyanate group at the polymeric polyol terminal, and subsequently reacted with at least one of the chain extension agent and polymerization terminator in an appropriate solvent. The two step method is preferable in order to obtain a homogeneous polymer solution. Examples of commonly known solutions usable in these methods include aromatic solutions such as benzene, toluene, xylene and so forth; ester based solutions such as ethyl acetate, butyl acetate and so forth; alcohol based solutions such as methanol, ethanol, isopropanol, n-butanol, diacetone alcohol and so forth; ketone based solutions such as acetone, methylethyl ketone, methylisobutyl ketone and so forth; and other solutions such as dimethylformamide, dimethyacetoamide, ethylene glycoldimethyl ether, tetrahydrofran, cyclohexanone and so forth. These can be used singly or in mixture of at least two kinds.

Further, a method of incorporating an amino group into polyurethane resin (1) is not limited, but polyamines may be reacted so as to make the amount of the amino group to be excessive with respect to the isocyanate group of the prepolymer at the terminal. The amount of an epoxy group-reactive functional group in polyurethane resin (1) is not specifically limited, but 0.1-20 KOHmg/g is commonly preferable. In the case of an amount of less than 0.1 KOHmg/g, plasticity and heat resistance of a polyurethane resin-silica hybrid are degraded. On the other hand, in the case of an amount exceeding 20 KOHmg/g, moisture resistance of the polyurethane resin-silica hybrid tends to be deteriorated. In addition, one having a urea bond in a polyurethane resin is further preferable in view of interlayer adhesion.

Epoxy group-containing alkoxysilane partial condensate (2) is prepared via dealcoholization reaction of epoxy compound (A) with alkoxysilane partial condensate (B).

As for epoxy compound (A), the number of epoxy group is not limited, provided that an epoxy compound contains one hydroxyl group in a molecule. Epoxy compound (A) having at most 15 carbon atoms is also preferable, since the low molecular weight epoxy compound exhibits good compatibility together with a high heat resistance property and adhesion-providing effect with respect to alkoxysilane partial condensate (B). Specific examples thereof include monoglycidyl ethers having one hydroxyl group at a molecular terminal obtained via reaction of water, dihydric alcohol or phenols with epichlorohydrin; polyglycidyl ethers having one hydroxyl group at a molecular terminal obtained via reaction of polyhydric alcohol like trihydric alcohol or higher hydric such as glycerin, pentaerythritol or such with epichlorohydrin; epoxy compounds having one hydroxyl group at a molecular terminal obtained via reaction of aminomonoalcohol with epichlorohydrin; and alicyclic hydrocarbon monoepoxides (epoxidized tetrahydrobenzyl alcohol) having one hydroxyl group at a molecular terminal. Of these epoxy compounds, glycidol is excellent in view of heat resistance-providing effect, and is also most preferable since high reactivity is produced with alkoxysilane partial condensate (B).

A hydrolysable alkoxysilane monomer represented by following Formula (a) is hydrolyzed in the presence of an acidic or alkaline water, and condensed partially to obtain usable alkoxysilane partial condensate (B).

$$R^1_pSi(OR^2)_{4-p} \qquad \text{Formula (a)}$$

wherein p is 0 or 1; $R^1$ represents a lower alkyl group, an aryl group or an unsaturated fatty group which may have a functional group combined directly with a carbon atom; $R^2$ represents a methyl group or an ethyl group; and $R^2$s each may be the same or be different.

Examples of the hydrolyzable alkoxysilane monomer include tetraalkoxy silanes such as tetramethoxy silane, tetraethoxy silane, tetrapropoxysilane, tetraisopropoxysilane and so forth; and trialkoxy silanes such as methyltrimethoxy silane, methyltriethoxy silane, methyltripropxy silane, methyltributoxy silane, ethyltrimethoxy silane, ethyltriethoxy silane, n-propyltrimethoxy silane, n-propyltriethoxy silane, isopropyltrimethoxy silane, isopropyltriethoxy silane and so forth. In addition, as alkoxysilane partial condensate (B), the foregoing listed can be used without any particular limitation, but in the case of using at least two kinds among the listed in mixture, preferable is a synthesis obtained by employing at least 70 mol % of alkoxysilane partial condensate (B), based on the total consitituting alkoxysilane monomer. Incidentally, when the content of a silane moiety contained in a polyurethane resin-silica hybrid is set to 1.0-30.0% by weight, very stable adhesiveness results.

Alkoxysilane partial condensate (B) is, for example, represented by following Formula (b) or Formula (c).

Formula (b)

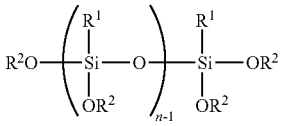

In Formula (b), $R^1$ represents a lower alkyl group, an aryl group or an unsaturated fatty group which may have a functional group combined directly with a carbon atom, and $R^2$ represents a methyl group or an ethyl group. $R^2$s each may be the same or be different.

Formula (c)

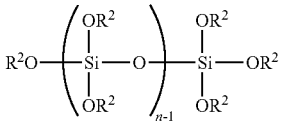

$R^2$ in Formula (c) is the same $R^2$ as in Formula (b).

Examples of the method of the resin layer include a dipping method, a spray method, a roll coat method and a hand-varnishing coat method in consideration of viscosity of the resin component constituting a resin layer, but these forming methods are not limited in the present invention. (Surface layer, etc.)

On the other hand, a silicone copolymerization urethane resin is provided as a resin used for a surface layer and so forth on the side of the surface layer further than the resin layer of the present invention, and can be synthesized with polyisocyanate which is at least difunctional, and a compound having in a molecule a silicone moiety containing a hydroxyl group which is at least difunctional. Preferably usable in the present invention is one having a JIS A hardness of 60-90° and a 100% modulus of $5\times10^6$-$30\times10^6$ Pa.

(Volume Resistance of Developing Roller)

Conductivity of a developing roller is possible to be evaluated via volume resistivity (called volume resistance or volume resistance value). The volume resistivity can be measured by a commonly known method.

In the present invention, it is assumed that appropriate conductivity appears when the developing roller volume resistivity measured by the following method is $1\times10^2$-$1\times10^9$ W·cm. A developing roller volume resistivity of $1\times10^3$-$1\times10^8$ W·cm is specifically preferable. The reason is that charge generated on the developing roller surface is appropriately leaked, and the leakage current is appropriately controlled when the developing roller volume resistivity is in the above-described range.

Figure 5:
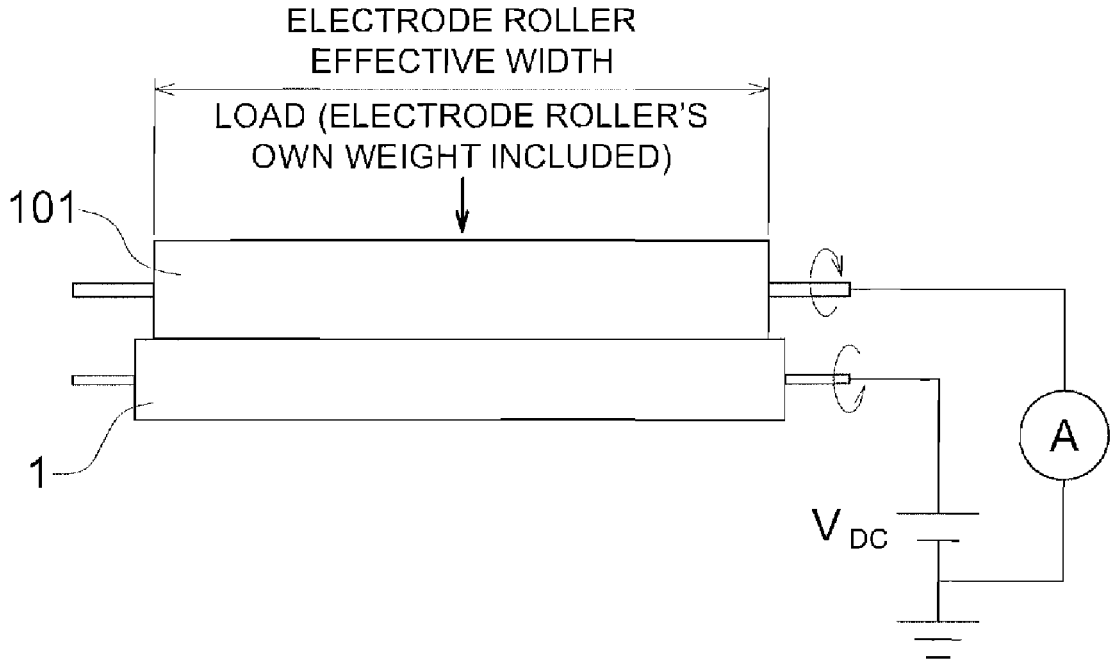
FIG. 5 is a schematic configuration diagram to explain a measuring method of volume resistivity of the developing roller.

The volume resistivity can be measured by a metal roller electrode method employing a typically known apparatus as shown in FIG. 5.

That is, stainless electrode roller 101 is brought into contact with developing roller 1, and pressed with a load of 9.8 N together with electrode roller 101 own weight. While rotating the roller in this situation, a voltage of +100 V is applied to an end of developing roller 1 to measure an electric current value. The developing roller volume resistivity is determined by using following Formula (1).

$$R=V/I \qquad \text{Formula (1)}$$

(Measuring Conditions)

Measurement environment: 23° C. and 57 RH %

Applied voltage: +100 V

Roller rotation speed: 27 rpm

Electrode roller load: 9.8 N (including electrode roller own weight)

Effective width of electrode roller: 230 mm (30 mm in diameter)

Measured item: Current value (applied voltage: a mean value after 5 seconds)

[Preparation of Developing Roller]

The developing roller of the present invention, for example, can be produced as described below.

First, each component of the above-described elastic layer (base rubber layer) 3-forming material is kneaded with a kneader or such to prepare the elastic layer 3-forming material. After shaft 2 made of metal is set to a hollow portion of a cylindrical die, and the above elastic layer 3-forming material is cast-molded into a spacing gap between above cylindrical die 10 and shaft 2, the die is covered and heated to crosslink the elastic layer 3-forming material. Formwork removal from the above cylindrical die is subsequently conducted to form elastic layer 3 on the outer circumferential surface of shaft 2. The resulting in which the elastic layer is formed on the outer circumferential surface of the shaft is designated as "base roller".

On the other hand, a resin layer 4 forming material is mixed with an organic solvent, and dissolved to prepare a resin layer 4 forming solution. Subsequently, inorganic or organic particles may be added into the resulting solution, and may be mixed. In this case, the above-described particles are not dissolved in a conventional solvent since these particles are rigid, but are dispersed in the solvent.

A surface layer 5 forming solution is also prepared by mixing a surface layer 5 forming material with an organic solvent, if desired.

After this, the above-described resin layer 4 forming solution is coated on the outer circumferential surface of elastic layer 3 of the above-described base roller. This coating method is not particularly limited, and a commonly known method such as a dipping method, a spray method or a roller coat method can be employed. A solvent in the above-described resin layer 4 forming solution is subsequently removed to form the resin layer via drying and heat treatment after coating (vulcanizing treatment at 120-200° C. for 20-90 minutes). And then, the above-described surface layer 5 forming solution is coated on the outer circumferential surface of above-described resin layer 4. A commonly known method as the coating method can be employed similarly to the case of the above-described resin layer 4 forming solution. A solvent in the above-described surface layer 5 forming solution is subsequently removed to form surface layer 5 via drying and heat treatment after coating (vulcanizing treatment at 120-200° C. for 20-90 minutes). In this way, a developing roller having a structure of at least two layers as shown in FIG. 1 can be prepared. As to this developing roller, elastic layer 3 preferably has a thickness of 1-10 mm, and more preferably has a thickness of 2-6 mm. Resin layer 4 preferably has a thickness of 3-30 μm, and more preferably has a thickness of 5-20 μm. The thickness of each layer including above-described resin layer 4 can be measured via microscope observation after obtaining a cut plane sample including surface layer 5, resin layer 4 and elastic layer 3 in the developing roller.

In addition, a developing roller having a three-layer structure was shown in FIG. 1 as an example of developing roller of the present invention, but the layer structure formed around the outer circumference of shaft 2 is not necessarily a structure of two or three layers, and a structure of the appropriate number of layers such as at least three layers on elastic layer 3 may be formed as roller usage. In this case, a layer located on the outermost surface of a resin layer is called a surface layer.

(Developer)

Toner of the present invention may also be prepared via a pulverizatio/classification process (via a so-called polymerization process). In the case of conducting the polymerization process, a process of salting-out/fusing resin particles is preferable.

(Monomer)

As a polymerizable monomer, a radically polymerizable monomer is employed as a mandatory component, and a crosslinking agent is usable, if desired. It is also preferable to contain at least one kind of radically polymerizable monomers having the following acidic group or basic group.

(1) Radically Polymerizable Monomer

Radically polymerizable monomers are not particularly limited, and commonly known radically polymerizable monomers are usable. These monomers can be used singly or in combination with at least two kinds in order to satisfy desired properties.

Specifically, usable examples thereof include an aromatic vinyl monomer, a (meth)acrylic acid ester based monomer, a vinyl ester based monomer, a vinyl ether based monomer, a monoolefin based monomer, a diolefin based monomer and a halogenated olefin based monomer.

Examples of the aromatic vinyl monomer include a styrene based monomer such as styrene, o-methylstyrene, m-methylstyrene, p-methylstyrene, p-methylstyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecyl styrene, 2,4-dimethylstyrene or 3,4-dichlorostyrne, and a derivative thereof.

Examples of the ester acrylate based monomer include methyl acrylate, ethyl acrylate, butyl acrylate, acrylic acid-2-ethylhexyl, cyclohexyl acrylate, phenyl acrylate, methyl methacrylate, ethyl methacrylate, butyl methacrylates, hexyl methacrylate, methacrylic acid-2-ethylhexyl, b-hydroxyacrylic acid ethyl, g-aminoacrylic acid propyl, stearyl methacrylate, dimethylaminoethyl methacrylate and diethylaminoethyl methacrylate.

Examples of the vinyl ester based monomer include vinyl acetate, vinyl propionate, vinyl benzoate and so forth.

Examples of the vinyl ether based monomer include vinylmethyl ether, vinylethyl ether, vinylisobutyl ether, vinylphenyl ether and so forth.

Examples of the monoolefin based monomer include ethylene, propylene, isobutylene, 1-butene, 1-pentene, 4-methyl-1-pentene and so forth.

Examples of the diolefin based monomer include butadiene, isoprene, chloroprene, and so forth.

Examples of the halogenation olefin based monomer include vinyl chloride, vinylidene chloride, vinyl bromide and so forth.

(2) Crosslinking Agent

A radical polymirizable crosslinking agent may be added as a crosslinking agent in order to improve toner characteristics. A crosslinking agent having at least two unsaturated bonds such as divinylbenzne, divinylnaphthalene, divinylether, diethylene glycol methacrylate, ethylene glycol dimethacrylate, polyethylene glycol dimethacrylate or diallyl phthalate is provided as the radically polymerizable crosslinking agent.

(3) Radically Polymerizable Monomer Having an Acidic Group or Radically Polymerizable Monomer Having a Basic Group Usable examples of the radically polymerizable monomer having an acidic group or the radically polymerizable monomer having a basic group include a carboxyl group-containing monomer, a sulfonic acid group-containing monomer, and amine based compounds such as primary amine, secondary amine, tertiary amine and quaternary ammonium salt.

Examples of the radically polymerizable monomer having an acidic group include an acrylic acid, a methacrylic acid, a fumaric acid, a maleic acid, an itaconic acid, a cinnamic acid, a maleic acid monobutyl ester, a maleic acid monooctyl ester and so forth.

Examples of the sulfonic acidic group-containing monomer include styrene sulfonic acid, allylsulfosuccinic acid, allylsulfosuccinic acid octyl and so forth.

These may be a structure of alkaline metal salt such as sodium or potassium, or a structure of alkaline earth metal salt such as calcium.

Examples of the radically polymerizable monomer having a basic group include amine based compounds such as dimethylamino ethyl acrylate, dimethylamino ethyl methacrylate, diethylaminoethyl acrylate, diethylaminoethyl methacrylate and quarternary ammonium salts of the above-described four compounds, and 3-dimethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; and vinylpyridine, vinyl pyrrolidone, vinyl-N-methylpyridinium chloride, vinyl-N-ethylpyridinium chloride, N,N-diallylmethyl ammonium chloride, and N,N-diallylethyl ammonium chloride.

As for a radically polymerizable monomer of the present invention, the content of the radically polymerizable monomer having an acidic group or the radically polymerizable monomer having a basic group is preferably 0.1-15% by weight, based on the total radically polymerizable monomer, and more preferably 0.1-10% by weight, though depending on the properties of a radically polymerizable crosslinking agent.

(Chain Transfer Agent)

Commonly known chain transfer agents are usable for the purpose of adjusting a molecular weight.

Chain transfer agents are not particularly limited, and usable examples thereof include octylmercaptan, dodecylmercaptan, tert-dodecylmercaptan, n-octyl-3-mercaptopropionic acid ester, carbon tetrabromide and styrene dimmer.

(Polymerization Initiator)

A radical polymerization initiator of the present invention is suitably usable, provided that it is water-soluble. Examples thereof include persulfates such as potassium persulfate, ammonium persulfate and so forth; azo based compounds such as 4,4'-azobis-4-cyano valeric acid, a salt thereof and 2,2'-azobis(2-amidinopropane) salt; and a paroxide compound.

Further, the above-described radically polymerizable monomer can be a redox based initiator in combination with a reducing agent, if desired. It is expected that polymerization is activated by using the redox based initiator, the polymerization temperature can be lowered, and the polymerization time can further be shortened.

The polymerization temperature may be optionally selected if it is at least the minimum radical generation temperature of a polymerization initiator, but a temperature range of 50-90° C. is usable. Polymerization is also possible to be done at room temperature or slightly more by employing a polymerization initiator working at normal temperature in combination with hydrogen peroxide-reducing agent (ascorbic acid and so forth).

(Surfactant)

In order to conduct polymerization employing the foregoing radically polymerizable monomer, oil droplets are desired to be dispersed in an aqueous medium by using a surfactant. Surfactants usable in this case are not particularly limited, but ionic surfactants listed below are usable.

Examples of the ionic surfactant include sulfonate such as dodecyl benzene sulfonic acid sodium, arylalkyl polyethersulfonic acid sodium, 3,3-disulphone diphenylurea-4,4-diazo-bis-amino-8-naphthol-6-sodium sulphonate, orthocarboxy benzene-azo-dimethylaniline or 2,2,5,5-tetramethyl-triphenyl methane-4,4-diazo-bis-1-naphthol-6-sodium sulfonate; sulfuric ester salt such as sodium dodecyl sulfate, sodium tetradecyl sulfate, pentadecyl sodium sulfate or sodium octylsulphate; and fatty acid salt such as sodium oleate, lauric acid sodium, capric acid sodium, caprylic acid sodium, caproic acid sodium, stearic acid potassium or oleic acid calcium.

Examples of the nonionic surfactant also include polyethylene oxide, polypropylene oxide, combination of polypropylene oxide and polyethylene oxide, ester of polyethyleneglycol and higher fatty acid, alkylphenol polyethylene oxide, ester of higher fatty acid and polyethyleneglycol, ester of higher fatty acid and polypropylene oxide, and sorbitan ester.

In the present invention, these are mainly employed for an emulsifying agent in emulsion polymerization. They may be used in other processes or other purpose of use.

(Colorant)

Inorganic pigment, organic pigment and dye are usable as a colorant.

Commonly known pigments are usable as the inorganic pigment. Specific inorganic pigments are exemplified below.

Carbon black such as furnace black, channel black, acetylene black, thermal black or lamp black is exemplified as a black pigment, and magnetic powder made of magnetite or ferrite is also employed.

These inorganic pigments can be used singly, or plural kinds can be used in combination, if desired. The addition amount of the pigment is 2-20% by weight, based on the weight of polymer, and preferably 3-15% by weight.

Commonly known organic pigments or dyes are usable as the organic pigment and the dye. The following examples of organic pigments and dyes are specifically listed.

Examples of pigments for magenta or red include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222 and so forth.

Examples of pigments for orange or yellow include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155, C. I. Pigment Yellow 156 and so forth.

Examples of pigments for green or cyan include C. I. Pigment Blue 15, C. I. Pigment Blue 15:2, C. I. Pigment Blue 15:3, C. I. Pigment Blue 16, C. I. Pigment Blue 60, C. I. Pigment Green 7 and so forth.

Further, examples of dyes include C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, C. I. Solvent Blue 95 and so forth.

These organic pigments and dyes can be used singly, or plural kinds can be used in combination, if desired. The addition amount of the pigment is 2-20% by weight, based on the weight of polymer, and preferably 3-15% by weight.

(Wax)

Toner usable in the present invention may contain wax, and the structure and composition of wax are not particularly limited. Usable examples thereof include low molecular weight polyolefin wax such as polypropylene or polyethylene; paraffin wax; Fischertropush wax, ester wax and so forth.

The addition amount is 1-30% by weight, based on the total weight of toner, preferably 2-20% by weight, and more preferably 3-15% by weight.

The toner usable in the present invention is preferably a toner wherein wax dissolved in a monomer is dispersed in water and polymerized to form resin particles in which an ester based compound is included, and to salt-out/fuse them with colorant particles.

(Manufacturing Process)

Toner usable in the present invention is preferably produced by a polymerization method comprising the steps of preparing resin particles including wax via a polymerization method after dispersing a monomer solution, in which wax is dissolved, in an aqueous medium; fusing resin particles in the aqueous medium employing the foregoing resin particle dispersion; removing a surfactant and so forth by filtrating the resulting particles from the aqueous medium; drying the resulting particles; and further adding external additives and so forth into particles obtained after drying. Resin particles herein may also be colored particles. Uncolored particles are also usable as resin particles. In this case, colored particles are prepared via a fusing process in an aqueous medium after adding a colorant particle dispersion into a resin particle dispersion.

It is preferable that resin particles prepared via a polymerization process are specifically utilized as a fusing process to conduct salting-out/fusing. Further, in the case of employing uncolored resin particles, resin particles and colorant particles can be subjected to salting-out/fusing in an aqueous medium.

Further, particles are not limited to a colorant and wax, but a charge control agent constituting the toner as a component can also be added in the present process as the particles.

Incidentally, the aqueous medium is water as a principal component, and has the content of water being at least 50% by weight. Water-soluble organic solvents other than water are also provided, and examples thereof include methanol, ethanol, isopropanol, butanol, acetone, methylethyl ketone, tetrahydrofuran and so forth.

As a preferable polymerization method of preparing toner usable in the present invention, provided can be a radical polymerization method in which a water-soluble polymerization initiator is added into a dispersion obtained by mechanically oil-droplet-dispersing a monomer solution in which wax was dissolved in a monomer, in an aqueous medium in which a surfactant of the critical micelle concentration or less is dissolved. In this case, an oil-soluble polymerization initiator may also be added into a monomer, and be usable.

The homogenizer for dispersing oil droplets is not specifically limited, but Cleamix, an ultrasonic homogenizer, a mechanical homogenizer, Manton-Gaulin, a pressure type homogenizer and so forth, for example, can be listed.

As is described before, the colorant itself may be used by modifying the surface. The surface modification method of colorants is a method in which colorants are dispersed in a solvent, and temperature is increased to accelerate a chemical reaction after adding a surface modification agent into the resulting solution. After terminating the reaction, the resulting solution is filtrated, washing and filtrating processes are repeatedly conducted with the same solvent, and then a drying process is carried out to obtain a pigment subjected to a treatment employing the surface modification agent.

There is a process in which colorant particles can be prepared by dispersing a colorant in an aqueous medium. This dispersion treatment is carried out in a state where the surfactant concentration is arranged to at least critical micelle concentration (CMC) in water.

Although the homogenizer employed during pigment dispersion is not specifically limited, preferably listed are Cleamix, an ultrasonic homogenizer, a mechanical homogenizer, a pressure homogenizer such as Manton-Gaulin or a pressure type homogenizer, a sand grinder, and a media type homogenizer such as a Getzmann mill or a diamond fine mill.

The foregoing surfactant is usable as a surfactant utilized here.

The salting-out/fusing process is a process wherein a salting-out agent containing an alkali metal salt or an alkaline earth metal salt is added into water, in which resin particles and colorant particles exist, as a coagulant having at least the critical coagulation concentration, and subsequently the resulting solution is heated to a temperature of at least the glass transition point of the resin particles to conduct salting-out and fusing simultaneously.

Examples of the alkali metal salt and alkaline earth metal salt usable as salting-out agents include: salts of alkali metals such as lithium, potassium and sodium; and salts of alkaline earth metals such as magnesium, calcium, strontium and barium. Of these, potassium, sodium, magnesium, calcium and barium are preferable. Listed as components constituting the salt may be, for example, chlorine salt, bromine salt, iodine salt, carbonate and sulfate.

(Other Additives)

A material as a toner substance in which various functions can be given, other than a resin, a colorant and wax is usable for toner. A charge control agent and so forth are specifically provided. These components can be added via various processes such as a process of including these inside toner after adding resin particles and colorant particles simultaneously at the stage of the foregoing salting-out/fusing, a process of adding these into the resin particle itself, and so forth.

Similarly, usable are commonly known various charge control agents which are water-dispersible. Examples thereof include a nigrosine based dye, a metal salt of a naphthenic acid or a higher fatty acid, alkoxylated amine, a quaternary ammonium salt compound, an azo based metal complex, and a salicylic acid metal salt or its metal complex.

(External Additives)

So-called external additives can be employed for toner usable in the present invention, and added to improve fluidity and an electrostatic property, and to enhance cleaning capability. These external additives are not particularly limited, and various inorganic and organic particles, and lubricants are usable.

Commonly known particles are usable as inorganic particles. Specifically usable are silica, titanium and alumina particles preferably having a number average primary particle diameter of 5-500 nm. These inorganic particles are preferably hydrophobic.

Examples of silica particles include commercially available products such as R-805, R-976, R-974, R-072, R-812 and P-809 produced by Nippon Aerosil Co., Ltd.; commercially available products such as HVK-2150 and H-200 produced by Höchst; commercially available products such as TS-720, TS-530, TS-610, H-5 and MS-5 produced by Cabot corporation.

Examples of titanium particles include commercially available products such as T-805 and T-604 produced by Nippon Aerosil Co., Ltd.; commercially available products such as MT-100S, MT-100B, MT-500BS, MT-600, MT-600SS and JA-1 produced by Tayca Corporation; commercially available products such as TA-300SI, TA-500, TAF-130, TAF-510, TAF-510T produced by Fuji Titanium Industry Co., Ltd.; and commercially available products such as IT-S, IT-OA, IT-OB and IT-OC produced by Idemitsu Kosan Co., Ltd.

Examples of alumina particles include commercially available products such as RFY-C and C-604 produced by Nippon Aerosil Co., Ltd.; and commercially available products such as TT-55 and so forth produced by Ishihara Sangyo Kaisha, Ltd.

Spherical organic particles having a number average primary particle diameter of approximately 10-2000 nm are usable as organic particles. These usable organic particles are formed from a homopolymer or its copolymer of styrene, methylmethacrylate or such.

As the lubricant, provided are higher fatty acid metal salts such as a stearic acid zinc salt, a stearic acid aluminum salt, a stearic acid copper salt, a stearic acid magnesium salt, a stearic acid calcium salt and so forth; an oleic acid zinc salt, an oleic acid manganese salt, an oleic acid iron salt, an oleic acid copper salt, an oleic acid magnesium salt and so forth; a palmitic acid zinc salt, a palmitic acid copper salt, a palmitic acid magnesium salt, a palmitic acid calcium salt and so forth; a linolic acid zinc salt, a linolic acid calcium salt and so forth; and a recinoleic acid zinc salt, a recinoleic acid calcium salt and so forth.

The addition amount of these external additives is preferably 0.1-5% by weight, based on the weight of toner.

Examples of commonly known mixers usable as a method of adding external additives include a tabular mixer, a Henschel mixer, a nauter mixer and a V-shaped mixer.

[Image Forming Method]

An image forming apparatus with non-magnetic single component development in the present invention comprises a developing roller, a toner layer regulating member and an auxiliary toner supply member, and it is usual that auxiliary toner supply member is brought into contact with the developing roller, and the toner layer regulating member is also brought into contact with the toner conveying member. This is a process in which the thin-layered non-magnetic toner is supplied onto the electrostatic latent image forming body surface to develop the latent image, employing the apparatus.

The toner layer regulating member exhibits functions which uniformly apply toner onto the toner conveying member and in addition which provides frictional electrification. Specifically employed as the members are elastic bodies such as urethane rubber and metal panels. The toner layer regulating member is brought into contact with the toner conveying member, whereby a thin toner layer is formed on the toner conveying member. The thin toner layer, as described herein, refers to a layer in the state that a toner layer is composed of at most 10 layers in a developing region and preferably at most 5 layers. The toner layer regulating member is preferably brought into contact with the toner conveying member at a pressure of 100 mN/cm to 5 N/cm, and more preferably at a pressure of 200 mN/cm to 4 N/cm. In the case of this pressure being less than 100 mN/cm, toner conveyance becomes fluctuated, resulting easily in uneven toner conveyance, whereby white a problem caused by white streak tends to occur. On the other hand, in the case of this pressure exceeding SN/cm, shortage of toner supply, and deformation and crushing of toner tend to occur. The toner conveying member preferably has a diameter of 10-50 mm.

The auxiliary toner supply member is a unit to uniformly supply toner to the developing roller. Employed as the units may be water wheel-shaped rollers fitted with stirring blades or sponge-shaped rollers. In the present invention, the diameter with respect to the toner supply member is preferably in the range of 0.2-1.5 times. When this diameter is too small, toner supply becomes insufficient. On the other hand, when this diameter is too large, the toner supply becomes excessive. Both cases tend to result in streaking image problems.

Specific examples of the electrostatic latent carrier include a selenium inorganic photoreceptor or an arsenic selenium inorganic photoreceptor, an amorphous silicon photoreceptor and an organic photoreceptor. Of these, an organic photoreceptor is preferable, but an organic photoreceptor having a charge generation layer and a charge transfer layer is more preferable.

Next, the developing device (developing unit) employed in an image forming method of the present invention will be specifically explained.

Figure 4:
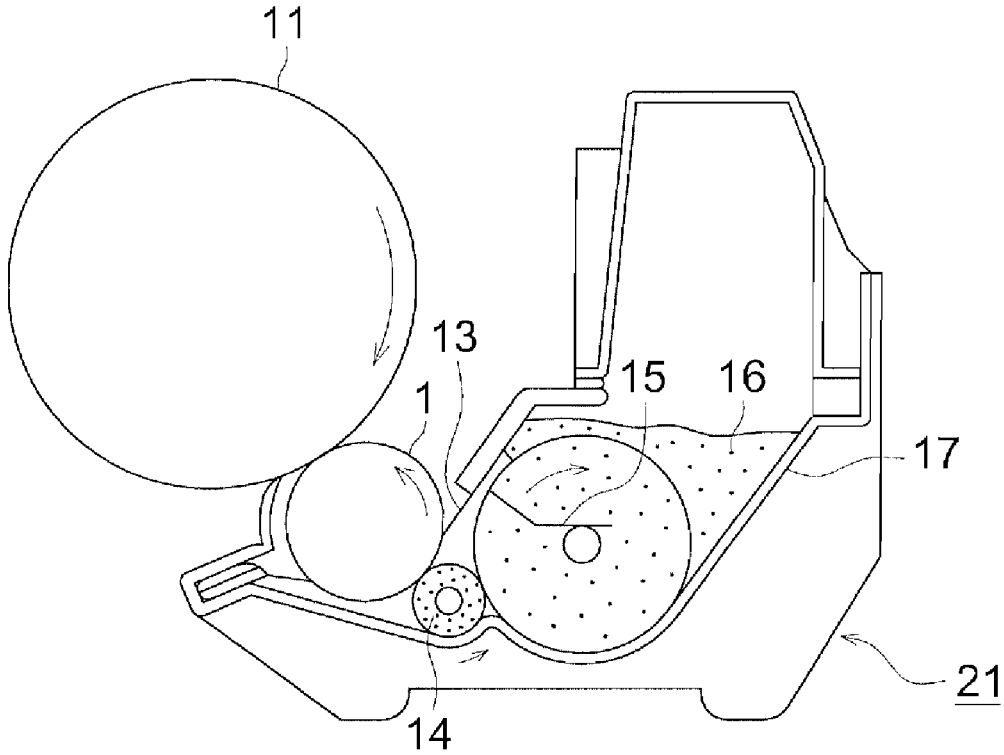
FIG. 4 is a schematic cross-sectional illustration of a developing device employed in an image forming method of the present invention.

FIG. 4 is a schematic cross-sectional illustration of a developing device employed in an image forming method of the present invention.

In FIG. 4, non-magnetic single component toner 16, stored in toner tank 17, is forcibly conveyed and supplied onto sponge roller 14 as an auxiliary toner supply member, employing stirring blade 15 as the auxiliary toner supply member. Toner adhered on the sponge roller is conveyed to developing roller 1 as a toner conveying member, via rotation in the arrowed direction of sponge roller 14, and is electrostatically and physically adsorbed onto its surface due to friction with developing roller 1. On the other hand, the toner adhered onto developing roller 1, as described above, is subjected to uniformly thin-layering by rotation of developing roller 1 in the arrowed direction, together with flexible steel blade 13 as a toner layer thickness regulating member, and is also subjected to frictional electrification. The thin toner layer formed on developing roller 1 comes into contact with or approaches the surface of electrophotographic drum (photoreceptor) 11, whereby a latent image is developed.

Incidentally, the structure of a developing device employed in the present invention is not particularly limited to the structure shown in FIG. 4.

A so-called contact heating process can be provided as a preferable fixing process usable in the present invention. Specific examples of the contact heating process include a heat pressure fixing process, and further a heat roller fixing process and a pressing contact heat-fixing process in which a rotary pressing member including a fixed heating body is employed for fixing.

The heat-roll fixing process is operated by an upper roller and a lower roller, wherein the upper roller contains a heat source inside the metal cylinder made of iron or aluminum covered with tetrafluoroethylene, polytetrafluoroethylene-perfluoroalkoxyvinyl ether copolymer or such, and the lower roller is made of a silicone rubber or others. A linear heater is provided as a heat source and is usually employed to heat the upper roller to a surface temperature of about 120-200° C. In the fixing section, pressure is applied between the upper roller and lower roller to deform the lower roller, whereby a so-called nip is formed. The nip width is 1-10 mm, preferably 1.5-7 mm. The fixing linear speed is preferably 40-600 mm/sec. When the nip width is small, heat can not be applied uniformly, and uneven fixing will occur. If the nip width is large, resin fusion will be accelerated and the problem of excessive fixing offset will arise.

A fixing cleaning mechanism may be provided to be utilized. As to this process, it is possible to use a process of supplying silicone oil to a fixing upper roller or film, or a cleaning process employing a pad, a roller, a web or such impregnated with silicone oil.

In the present invention, also usable is a process in which a rotary pressing member including a fixed heating body is employed for fixing.

This fixing process is a pressing contact heat-fixing process in which fixing is conducted with a fixed heating body and a pressing member by which contact-pressing facing the heating body is applied, and a recording material is attached to the heating body via a film.

This pressing contact heat-fixing device is equipped with a heating body having a smaller heat capacity than that of a conventional heating body, and has a heating portion in the form of lines at a right angle to the passing direction of the recording material. The maximum temperature of the heating portion is usually 100-300° C.

EXAMPLE

Next, the embodiments of the present invention will further be explained, referring to examples, but the present invention is not limited thereto.

Incidentally, "parts" in the description represents "parts by weight"

Preparation Example of Developing Roller

Mixed and dispersed were 100 parts of X-34-424:A/B (silicone rubber, produced by Shin-Etsu Chemical Co., Ltd.) and 100 parts of X-34-387:A/B (silicone rubber, produced by Shin-Etsu Chemical Co., Ltd.), and 80 parts of Ketjen Black were further added into this to prepare elastic layer-forming material 1.

Preparation Example 1 of Polyurethane Resin-Silica Hybrid Resin Layer-Forming Material Into a reactor fitted with a stirrer, a thermometer and a nitrogen gas-introducing tube, charged were 100 g of polycarbonate diol having a number average molecular weight of 2000 (PLACCEL CD220, produced by Daicel Chemical Industries, Ltd.) and 278 g of isophorone diisocyanate, the system was reacted under nitrogen gas stream at 100° C. for 6 hours to prepare a prepolymer having a released isocyanate value of 3.44%, and 548 g of methylethyl ketone was subsequently added into the resulting to prepare an even urethane prepolymer solution. Next, 1000 g of the above-described urethane prepolymer solution was added in the presence of a mixture composed of 71.8 g of isophorone diamine, 4.0 g of di-n-butylamine, 906 g of methylethyl ketone and 603 g of isopropyl alcohol, and the resulting was reacted at 50° C. for 3 hours. The resulting polyurethane resin solution {hereinafter, referred to as polyurethane resin (1A)} had a resin solid content of 30% by weight and an amine value of 1.2 KOHmg/g.

On the other hand, 1400 g of glycidol (EPIOL, produced by NOF Corporation) and 8957.9 g of a tetramethoxysilane partial condensate having a Si average number of 4 (Methyl Silicate 51, produced by Tama Chemicals Co., Ltd.) were charged into a reactor fitted with a stirrer, a diversion device, a thermometer and a nitrogen gas-introducing tube, and temperature was increased to 90° C. while stirring under nitrogen gas stream to react with an addition of 2.0 g of dibutyltin dilaurate as a catalyst. In the reaction, methanol was distilled away employing a diversion device, and the system was cooled when the amount reached about 630 g. Time consumed for cooling after increasing temperature was 5 hours. Next, approximately 80 g of methanol remaining in the system was removed at a reduced pressure of 13 kPa for 10 minutes to obtain epoxy group-containing alkoxysilane partial condensate (2A).

After 500 g of the foregoing polyurethane resin (1A) was increased to a temperature of 50° C., 10.95 g of the foregoing epoxy group-containing alkoxysilane partial condensate (2A) was added, and the resulting was reacted under nitrogen gas stream at 60° C. for 4 hours to prepare an alkoxy group-containing silane modified polyurethane resin.

Mixed and dispersed were 100 parts of the resulting alkoxy group-containing silane modified polyurethane resin and 30 parts of Ketjen Black (carbon black) to prepare resin layer-forming material 1 for forming a layer immediately above an elastic layer.

In addition, the content of Si contained in the solid residue in the alkoxy group-containing silane modified polyurethane resin was 3.3% in silica weight conversion.

Preparation Example 2 of Polyurethane Resin-Silica Hybrid Resin Layer-Forming Material A polyurethane resin solution {hereinafter, referred to as polyurethane resin (1B)} was prepared in the same reaction as in preparation example 1 of the resin layer-forming material, except that "PLACCEL CD220" was replaced by polyester polyol having a number average molecular weight of 2000 (Kurapol P2010, produced by Kuraray Co., Ltd.). Polyurethane resin (1B) had a resin content of 30% and an amine value of 1.2 KOHmg/g.

Into the same reactor as in preparation example 1 of the resin layer-forming material, charged were 250.0 g of glycidol and 2675.4 g of a tetramethoxysilane partial condensate having a Si average number of 10 (Methyl Silicate 56, produced by Tama Chemicals Co., Ltd.), and temperature was increased to 90° C. while stirring under nitrogen gas stream to react with an addition of 0.5 g of dibutyltin dilaurate as a catalyst. In the reaction, methanol was distilled away employing a diversion device, and the system was cooled when the amount reached about 125 g. Time consumed for cooling after increasing temperature was 6.5 hours. Next, approximately 5 g of methanol remaining in the system was removed at a reduced pressure of 13 kPa for 10 minutes to obtain epoxy group-containing alkoxysilane partial condensate (2B).

After 500 g of the foregoing polyurethane resin (1B) was increased to a temperature of 50° C., 17.75 g of the foregoing epoxy group-containing alkoxysilane partial condensate (2B) was added, and the resulting was reacted under nitrogen gas stream at 60° C. for 4 hours to prepare an alkoxy group-containing silane modified polyurethane resin.

Mixed and dispersed were 100 parts of the resulting alkoxy group-containing silane modified polyurethane resin and 30 parts of Ketjen Black (carbon black) to prepare resin layer-forming material 2 for forming a layer immediately above an elastic layer.

In addition, the content of Si contained in the solid residue in the alkoxy group-containing silane modified polyurethane resin was 6.0% in silica weight conversion.

Preparation Example 3 of Polyurethane Resin-Silica Hybrid Resin Layer-Forming Material Into the same reactor as in preparation example 1 of the resin layer-forming material, charged were 1000 g of "PLACCEL CD220" and 278 g of isophorone diisocyanate, the system was reacted under nitrogen gas stream at 100° C. for 6 hours to prepare a prepolymer having a released isocyanate value of 3.44%, and 548 g of methylethyl ketone was subsequently added into the resulting to prepare an even urethane prepolymer solution. Next, 1000 g of the above-described urethane prepolymer solution was added in the presence of a mixture composed of 77.6 g of isophorone diamine, 2.4 g of di-n-butylamine, 913 g of methylethyl ketone and 607 g of isopropyl alcohol, and the resulting was reacted at 50° C. for 3 hours. The resulting polyurethane resin solution {hereinafter, referred to as polyurethane resin (1C)} had a resin solid content of 30% by weight and an amine value of 2.4 KOHmg/g. After 500 g of the foregoing polyurethane resin (1C) was increased to a temperature of 50° C., 18.54 g of the foregoing epoxy group-containing alkoxysilane partial condensate (2A) obtained in preparation example 1 of the resin layer-forming material was added, and the resulting was reacted under nitrogen gas stream at 60° C. for 4 hours to prepare an alkoxy group-containing silane modified polyurethane resin.

Mixed and dispersed were 100 parts of the resulting alkoxy group-containing silane modified polyurethane resin and 30 parts of Ketjen Black (carbon black) to prepare resin layer-forming material 3 for forming a layer immediately above an elastic layer.

In addition, the content of Si contained in the solid residue in the alkoxy group-containing silane modified polyurethane resin was 6.4% in silica weight conversion.

Preparation Example 4 of Polyurethane Resin-Silica Hybrid Resin Layer-Forming Material Into the same reactor as in preparation example 1 of the resin layer-forming material, charged were 1000 g of "Kurapol P2010", 40 g of dimethylol butanoic acid and 342 g of isophorone diisocyanate, the system was reacted under nitrogen gas stream at 100° C. for 6 hours to prepare a prepolymer having a released isocyanate value of 3.28%, and 593 g of methylethyl ketone was subsequently added into the resulting to prepare an even urethane prepolymer solution. Next, 1000 g of the above-described urethane prepolymer solution was added in the presence of a mixture composed of 59.7 g of isophorone diamine, 9.9 g of di-n-butylamine, 897 g of methylethyl ketone and 599 g of isopropyl alcohol, and the resulting was reacted at 50° C. for 3 hours. The resulting polyurethane resin solution {hereinafter, referred to as polyurethane resin (1D)} had a resin solid content of 30% by weight and an amine value of 3.0 KOHmg/g. After 500 g of the foregoing polyurethane resin (1D) was increased to a temperature of 50° C., 18.54 g of the foregoing epoxy group-containing alkoxysilane partial condensate (2A) obtained in preparation example 1 of the resin layer-forming material was added, and the resulting was reacted under nitrogen gas stream at 60° C. for 4 hours to prepare an alkoxy group-containing silane modified polyurethane resin.

Mixed and dispersed were 100 parts of the resulting alkoxy group-containing silane modified polyurethane resin and 30 parts of Ketjen Black (carbon black) to prepare resin layer-forming material 4 for forming a layer immediately above an elastic layer.

In addition, the content of Si contained in the solid residue in the alkoxy group-containing silane modified polyurethane resin was 7.8% in silica weight conversion.

Preparation Example 1 of Developing Roller (Example 1)

Figure 2:
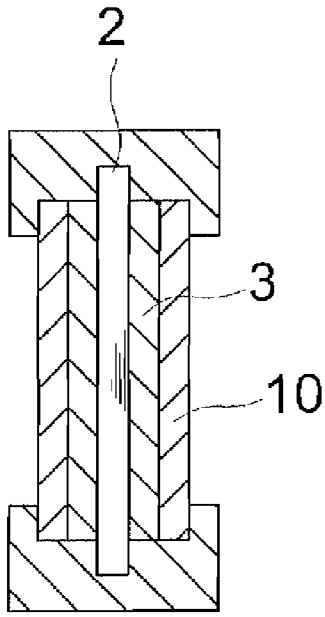
FIG. 2 is a schematic configuration diagram of a die used for a method of manufacturing a base roller of the present invention.

After a core metal made of SUS303 (a diameter of 10 mm) as a shaft was set to the inside of a roller, the foregoing elastic layer-forming material 1 was injected into a gap portion between the foregoing shaft and the inner circumferential surface of the roller (refer to FIG. 2), and vulcanized while heating at 180° C. for one hour. Subsequently, formwork removal was conducted, and the secondary vulcanizing treatment was further carried out at 200° C. for 4 hours to form an elastic layer having a thickness of 5 mm on the outer circumferential surface of the shaft.

After the shaft with the resulting elastic layer was removed from the above-described die, and resin layer-forming material 1 was formed 15 μm thick on the outer circumferential surface of the elastic layer, a heat treatment was conducted at 100° C. for one hour to form a resin layer made of a polyurethane resin-silica hybrid. This roller is designated as developing roller 1.

Preparation Example 2 of Developing Roller (Example 2)

A developing roller of the present invention was prepared similarly to preparation example 1 of developing roller, except that resin layer-forming material 1 was replaced by resin layer-forming material 2 with a thickness of 10 μm. This roller is designated as developing roller 2.

Preparation Example 3 of Developing Roller (Example 3)

A developing roller of the present invention was prepared similarly to preparation example 1 of developing roller, except that resin layer-forming material 1 was replaced by resin layer-forming material 3 with a thickness of 12 μm. This roller is designated as developing roller 3.

Preparation Example 4 of Developing Roller (Example 4)

A developing roller of the present invention was prepared similarly to preparation example 1 of developing roller, except that resin layer-forming material 1 was replaced by resin layer-forming material 4. This roller is designated as developing roller 4.

Preparation Example 1 of Comparative Developing Roller (Comparative Example 1)

A comparative developing roller was prepared similarly to preparation example 1 of developing roller, except that resin layer-forming material 1 was replaced by bis-1,2-triethoxysilylethane to be evenly coated, and a heat treatment was conducted at 100° C. for one hour. This roller is designated as comparative developing roller 1.

Preparation Example of Toner

Preparation Example 1 of Resin Particles

In a flask fitted with a stirrer, 72.0 g of wax (pentaerythritol tetrastearic acid ester) was added into a monomer mixture composed of 115.1 g of Styrene, 42.0 g of n-butylacrylate and 10.9 g of methacrylic acid, and dissolved while heating at 80° C. to prepare a monomer solution.

On the other hand, a surfactant solution (aqueous medium) in which 7.0 g of anionic surfactant (sodium dodecylbenzenesulfonate: SDS) was dissolved in 2760 g of ion-exchange water was charged into a separable flask fitted with a stirrer, a thermometer, a cooling tube and a nitrogen gas-introducing tube, and the inner temperature was increased to 80° C. under nitrogen gas stream while stirring at a stirring rate of 230 rpm. Next, the foregoing monomer solution (at 80° C.) was mixed and dispersed in the foregoing surfactant solution (at 80° C.), employing a mechanical homogenizer (CLEARMIX, produced by M Technique Co., Ltd.) with a circulating path to prepare an emulsified liquid in which emulsification particles (oil droplets) having an even particle diameter were dispersed.

An initiator solution in which 0.84 g of polymerization initiator (potassium persulfate: KPS) was dissolved in 200 g of ion-exchange water was added into this dispersion, and this system was heated at 80° C. for 3 hours while stirring to conduct polymerization reaction. A solution in which 7.73 g of polymerization initiator (KPS) was dissolved in 240 g of ion-exchange water was added into the resulting reaction solution, and a mixture composed of 383.6 g of styrene, 140.0 g of n-butylacrylate, 36.4 g of methacrylic acid and 12 g of n-octylmercaptan was dripped spending 100 minutes, after the temperature was increased to 80° C. spending 15 minutes. After stirring this system at 80° C. for 60 minutes, a resin particle dispersion containing wax {hereinafter, referred to as "Latex (1)"} was prepared by cooling this system to 40° C.

Preparation Example 1 of Colorant Dispersion

On the other hand, 9.2 g of n-dodecyl sodium sulfate was dissolved in 160 g of ion-exchange water while stirring. Twenty gram of carbon black (Mogul L, produced by Cabot Corporation) as a colorant was gradually added while stirring this solution, and the system was subsequently dispersed employing a mechanical homogenizer (CLEARMIX, produced by M Technique Co., Ltd.) to prepare a colorant particle dispersion {hereinafter, referred to as "colorant dispersion (1)"}. A particle diameter of the colorant particle in colorant dispersion (1), which was measured employing an electrophoresis light-scattering photometer (ELS-800, manufactured by Ohtsuka Denshi Co., Ltd.), was 120 nm in weight average particle diameter.

Preparation Example 2 of Colorant Dispersion

A colorant particle dispersion {hereinafter, referred to as "colorant dispersion (2)"} was prepared similarly to preparation example 1 of colorant dispersion, except that 20 g of carbon black was replaced by 20 g of a pigment "C.I. pigment yellow 74". A particle diameter of the colorant particle in the resulting colorant dispersion (2), which was measured employing an electrophoresis light-scattering photometer (ELS-800, manufactured by Ohtsuka Denshi Co., Ltd.), was 120 nm in weight average particle diameter.

Preparation Example 3 of Colorant Dispersion

A colorant particle dispersion {hereinafter, referred to as "colorant dispersion (3)"} was prepared similarly to preparation example 1 of colorant dispersion, except that 20 g of carbon black was replaced by 20 g of a quinacridone based magenta pigment "C.I. pigment red 122". A particle diameter of the colorant particle in the resulting colorant dispersion (3), which was measured employing an electrophoresis light-scattering photometer (ELS-800, manufactured by Ohtsuka Denshi Co., Ltd.), was 120 nm in weight average particle diameter.

Preparation Example 4 of Colorant Dispersion

A colorant particle dispersion {hereinafter, referred to as "colorant dispersion (4)"} was prepared similarly to preparation example 1 of colorant dispersion, except that 20 g of carbon black was replaced by 20 g of a phthalocyanine based cyan pigment "C.I. pigment blue 15:3". A particle diameter of the colorant particle in the resulting colorant dispersion (4), which was measured employing an electrophoresis light-scattering photometer (ELS-800, manufactured by Ohtsuka Denshi Co., Ltd.), was 120 nm in weight average particle diameter.

Preparation Example K1 of Colorant Particle

Into a reaction vessel (four-necked flask) fitted with a thermometer, a cooling tube, a stirrer with two stirring blades having a crossing angle of 20°, and a shape-monitoring device, charged were 1250 g (solid content conversion) of latex (1), 2000 g ion-exchange water and the total amount of colorant dispersion (1), the inner temperature was adjusted to 25° C., and an aqueous 5 mol/liter sodium hydroxide solution was subsequently added into this dispersion mixture solution to adjust pH to 10.0. Next, an aqueous solution in which 52.6 g of magnesium chloride-hexahydrate was dissolved in 72 g of ion-exchange water was added at 25° C. for 10 minutes while stirring. After this, the temperature of this system was immediately increased to 95° C. at a temperature increasing rate of 14° C./min, spending 5 minutes.

In this situation, the particle diameter of associated particles was measured employing "Multisizer 3, manufactured by Beckman Coulter Co., Ltd.", and when the volume-based median diameter reached 6.5 μm, particle growth was terminated by adding an aqueous solution in which 115 g of sodium chloride was dissolved in 700 g of ion-exchange water. Further after continuing a fusing treatment and then conducting a ripening treatment while stirring at a stirring rotation speed of 120 rpm at a liquid temperature of 90° C. for 8 hours, this system was cooled to 30° C. at a temperature cooling rate of 10° C./min, pH was adjusted to 3.0 by adding a hydrochloric acid, and then stirring was terminated.

The resulting particles were filtrated, and repeatedly washed with ion-exchange water to conduct a submerged classification treatment employing a centrifugal separator. After this, prepared was the colorant particle {hereinafter, referred to as "colorant particle (K1)"} having a moisture content of 1.0% obtained via a drying process employing a flash jet dryer.

Preparation Example Y1 of Colorant Particle

Colorant particle (Y1) was prepared similarly to preparation example K1 of colorant particle, except that the total amount of colorant dispersion (1) was replaced by the total amount of colorant dispersion (2).

Preparation Example M1 of Colorant Particle

Colorant particle (M1) was prepared similarly to preparation example K1 of colorant particle, except that the total amount of colorant dispersion (1) was replaced by the total amount of colorant dispersion (3).

Preparation Example C1 of Colorant Particle

Colorant particle (C1) was prepared similarly to preparation example K1 of colorant particle, except that the total amount of colorant dispersion (1) was replaced by the total amount of colorant dispersion (4).

Preparation Example 1 of Toner

Into the above-described colorant particles, added were 0.8 parts by weight of hydrophobic silica having a number average primary particle diameter of 12 nm and a hydrophobic degree of 65, and 0.5 parts by weight of hydrophobic titania having a number average primary particle diameter of 30 nm and a hydrophobic degree of 55, and the resulting was mixed employing a Henschel mixer to prepare each toner. These are designated as black toner 1, yellow toner 1, magenta toner 1 and cyan toner 1, respectively.

[Performance Evaluation]

(Interlayer Adhesion)

As shown in FIG. 3(*a*), incisions with a width of 2.5 cm indicated by dashed line X were made along with outer circumferential surface of resin layer 4 at the center portion of the resulting developing roller, and an incision (dashed line Y) was further made in the shaft direction on resin layer 4. Resin layer 4 was slightly peeled from the incised portion, and then the end of peeled resin layer 4 was raised vertically employing "Autograph AGS, manufactured by Shimadzu Corporation" (Z-pointing arrow direction), as shown in FIG. 3(*b*). How much force was necessary to start peeling off the resin layer out of an elastic layer immediately below the resin layer was measured to evaluate the interlayer adhesion.

The resin layer was raised specifically at a speed of 100 mm/min. In the process of increasing a load value to 20 N, a load value in which the resin layer was possible to be raised with no increase of load was determined.

The evaluation was made according to the following criteria employing this value.

A: A load value to start peeling off is at least 10.0 N.

B: A load value to start peeling off is at least 4.0 N and less than 10.0 N.

C: A load value to start peeling off is less than 4.0 N.

(Image Evaluation)

Three thousand A4 size practical prints were evaluated in a pixel ratio of 20% (5% of each color of yellow, magenta, cyan and black in full color mode) by utilizing the resulting developing roller installed in a color laser printer (Magicolor 2300DL, manufactured by Konica Minolta Business Technologies, Inc.). Density unevenness and fog density were evaluated at room-temperature and low-humidity (20° C. and 10% RH) at the initial stage and after printing 3000 prints.

Density Unevenness

A4 size solid image (a pixel ratio of 100%) was printed at the initial stage and after printing 3000 prints. The reflection density at each of 10 portions selected at random on the printed A4 size solid image (a pixel ratio of 100%) was measured employing a Macbeth reflection densitometer RD-918 to evaluate the density unevenness from the difference between maximum and minimum values of solid image density.

Fog

In order to evaluate fog density, the white portion was measured employing a Macbeth reflection densitometer RD-918, and the fog density was evaluated via relative reflection density in which reflection density of a paper sheet was set to "0".

TABLE 1

| | | | Image evaluation | | | |
|---|---|---|---|---|---|---|
| | | | At initial stage | | After printing 3000 prints | |
| No. | Developing roller No. | Interlayer adhesion | Density unevenness | Fog | Density unevenness | Fog |
| Example 1 | Developing roller 1 | A | 0.00 | 0.000 | 0.01 | 0.001 |
| Example 2 | Developing roller 2 | A | 0.01 | 0.001 | 0.01 | 0.001 |
| Example 3 | Developing roller 3 | A | 0.00 | 0.001 | 0.01 | 0.001 |
| Example 4 | Developing roller 4 | A | 0.01 | 0.001 | 0.01 | 0.002 |
| Comparative example 1 | Comparative developing roller 1 | C | 0.01 | 0.001 | 0.15 | 0.014 |

As is clear from Table 1, it is to be understood that Examples 1-4 of the present invention exhibit excellent interlayer adhesion between an elastic layer and a resin layer immediately above the elastic layer. The increase of residual potential was inhibited during repetitive operation, and neither scattered toner and toner leakage nor density unevenness and fog caused by unevenly charged toner were generated, whereby excellent images were possible to be obtained even after printing 3000 prints.

On the contrary, Comparative example 1 of the present invention exhibit inferior interlayer adhesion between an elastic layer and a resin layer immediately above the elastic layer, and occurrence of peeling results. Further, the scattered toner and toner leakage, as well as the density unevenness and fog were also generated.

EFFECT OF THE INVENTION

The present invention is possible to provide a developing roller in which increase of residual potential is inhibited during repetitive operation, scattering of toner is prevented, appropriate elasticity is exhibited and a resin layer capable of preventing uneven charging of toner and image unevenness is prepared, and also to provide a image forming method employing the developing roller.

What is claimed is:

1. A developing roller comprising an elastic layer made of silicone rubber provided around a conductive shaft, and a resin layer further provided on the elastic layer, wherein the resin layer comprises a polyurethane resin-silica hybrid having an inorganic structure of a silica unit as a principal component.

2. The developing roller of claim 1, wherein a silane moiety content in the polyurethane resin-silica hybrid is 1.0-30.0% by weight.

3. The developing roller of claim 1, wherein the polyurethane resin-silica hybrid comprises a urea bond.

4. An image forming method comprising the steps of:

(a) conveying a developer comprising a toner to a developing region with a developing roller; and (b) developing an electrostatic latent image formed on an electrostatic latent image carrier for visualization, wherein the developing roller comprises an elastic layer made of silicone rubber provided around a conductive shaft, and a resin layer further provided on the elastic layer; and the resin layer comprises a polyurethane resin-silica hybrid having an inorganic structure of a silica unit as a principal component.

5. The image forming method of claim 4, wherein a silane moiety content in the polyurethane resin-silica hybrid is 1.0-30.0% by weight.

6. The image forming method of claim 4, wherein the polyurethane resin-silica hybrid comprises a urea bond.

* * * * *